United States Patent [19]

Mann

[11] Patent Number: 4,703,529

[45] Date of Patent: Nov. 3, 1987

[54] METHOD AND APPARATUS FOR COVERING A BED

[76] Inventor: Toni Mann, 3234 Euclid Hts. Blvd., Cleveland Hts., Ohio 44118

[21] Appl. No.: 796,164

[22] Filed: Nov. 8, 1985

[51] Int. Cl.[4] ..... A47G 9/02

[52] U.S. Cl. ..... 5/494; 5/496

[58] Field of Search ..... 5/494–498; 24/72.5

[56] References Cited

U.S. PATENT DOCUMENTS

| | | | |
|---|---|---|---|
| 892,047 | 6/1908 | Halterman | 5/494 |
| 2,037,216 | 4/1936 | Echlin | 5/494 |
| 2,151,434 | 3/1939 | Mulah | 5/494 |
| 2,722,694 | 11/1955 | Bryant | 5/494 |
| 3,121,885 | 2/1964 | Cherry | 5/494 |
| 3,243,827 | 4/1966 | Kintner | 5/496 |
| 4,045,832 | 9/1977 | DiForti et al. | 5/496 |
| 4,494,262 | 1/1985 | Robertson | 5/496 |

*Primary Examiner*—Gary L. Smith
*Assistant Examiner*—Michael F. Trettel
*Attorney, Agent, or Firm*—George J. Coghill

[57] ABSTRACT

A bedspread covering and method of using it in combination with a bed is disclosed. The covering has special advantage when used with a bunk bed having extended bedposts and a footboard or headboard, to provide a snug, neat look. The covering is generally rectangular, with at least two corners having "cutouts" forming end and side flaps. The cutouts align with the bedposts. The end flap extends downward at the end of the bed, and the side flap extends downward along the side of the bed. Elastic tabs with fasteners are located at each of the corners with cutouts to unfastenably and elastically attach the end flap and the side flap together and retain the bedspread snugly and neatly on the bed.

35 Claims, 5 Drawing Figures

FIG. 1
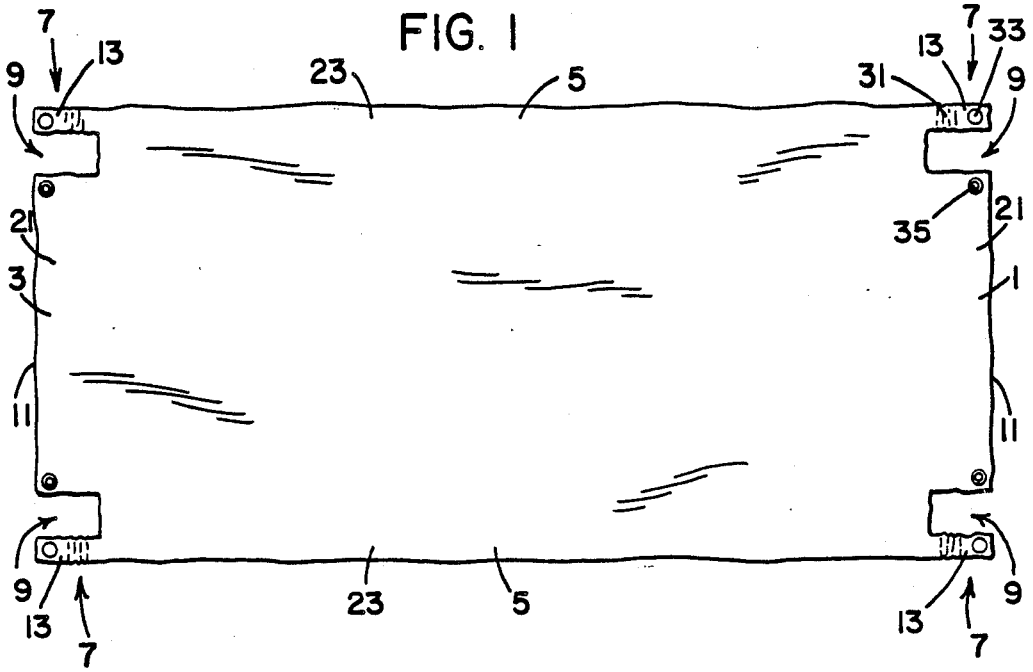
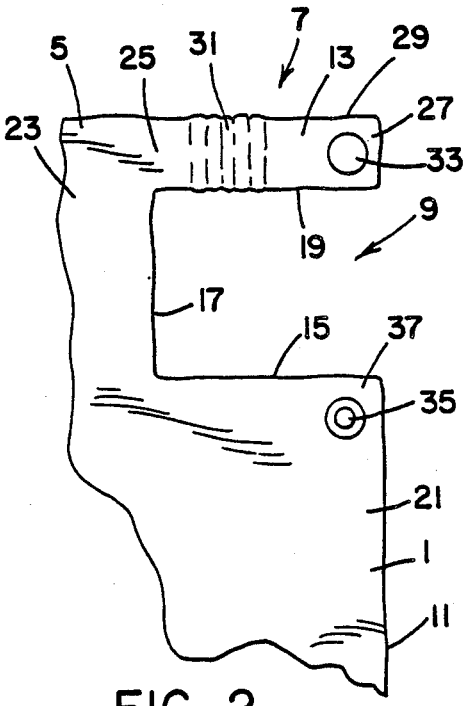
FIG. 2
FIG. 3
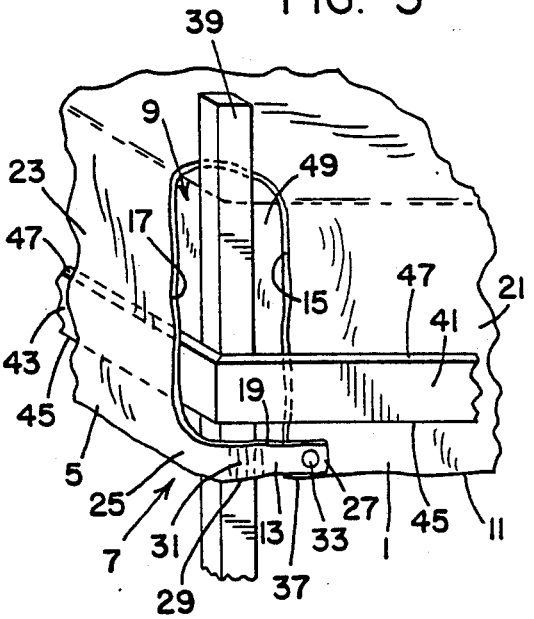

METHOD AND APPARATUS FOR COVERING A BED

BACKGROUND OF THE INVENTION

1. Field of the Invention

This invention relates generally to bed coverings, and more particularly relates to top or outer bedspread coverings.

2. Description of the Prior Art

There are many beds in use which, because of their construction, are not readily adaptable to the use of a standard rectangular bed spread or outer or top covering. Variably, many of these beds have bedposts at the corners which may extend upward beyond the top surface of the matress, and foot or head boards that result in difficulty when attempting to "make" the bed with a standard rectangular spread and still give it a neat look. This is especially true of childrens beds, and in particular "bunk beds", when the children are expected to make the bed.

Until this present invention, it appears that there never has been any bedspread developed particularly for bunkbeds or similar type bedframes.

SUMMARY OF THE INVENTION

The present invention provides such a bedspread particularly usefull with bunk beds and similar type bedframes. Generally it comprises a rectangular fabric having two opposed foot/head ends, two opposed sides, and four corner portions, typical of common bedspreads already in use. However, in the bedspread of the present invention, at least two of the corner portions are notched with a cutout. The cutouts can be generally square and defined by first and second adjacent borders oriented generally perpendicular to two adjacent edges of the spread. Each cutout partially defines first and second flaps on two adjacent edges. A tab, preferably elastic, is located at each notched corner portion, and has a proximal end attached to one of the adjacent flaps and an opposed distal end with a fastener thereon. A second fastener, which mates to the fastener on the tab, is attached to the other adjacent flap, to allow these two adjacent flaps to be removeably fastened together through the tab. The length of the tab(s) is made sufficient to separate the first and second border of the cutout by at least one inch when the fasteners are joined.

In combination with a bed, the flaps extend downward along the side and end of the mattress and can either be positioned outwardly of the frameboards of the bed, or one or both can be positioned between the frameboard and the mattress. Preferably, the outer edges of the flaps extend downward below the lower portion of the frameboards, and the tab, extends at least partially around the bedpost before it is attached to the fastener on the other flap to securely and snugly position the bedspread on the bed.

The tab, in a preferred form, has an elongated edge in line with the edge of the flap it is attached to. The tab can be nonremoveably attached to either an end flap or a side flap, or can be made unfastenable from both of these adjacent flaps.

The method includes, in various combination, the steps of: placing on a bed a bedspread with at least two notched corners defined by side borders; aligning the notches with bedposts of the bed frame; positioning two adjacent flaps, each of which is at least partially defined by the border of one of the notches, downward along the vertical edges of the mattress; positioning the bottom edges of the flaps below the lower edge of the frame boards; positioning the tab at least partly around the bedpost; and fastening the tab to the adjacent flap.

BRIEF DESCRIPTION OF THE DRAWINGS

The above noted and other inventive aspects of the invention can be more readily understood by reference to the accompanying DRAWING FIGURES, in which:

FIG. 1 is a top view of the preferred embodiment of the bedspread of the present invention;

FIG. 2 is an expanded top view of one corner of the bedspread of FIG. 1

FIG. 3 is an isometric view of the bedspread of FIG. 1 in combination with, and in use on, a typical bunk bed;

DESCRIPTION OF THE PREFERRED EMBODIMENT

Figure 4:
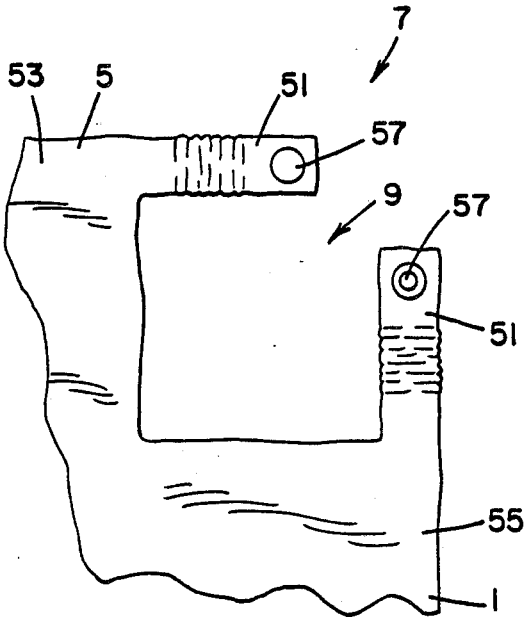
FIG. 4 is a top view of one corner of an alternate embodiment of a bed spread according to the invention.

Referring first to FIGS. 1, 2, and 3, wherein identical elements have been given identical reference numerals throughout, the preferred embodiment is made from any suitable fabric for bedspreads, and is flat and generally rectangular, extending in a lengthwise direction from a foot portion 1 to an opposed head portion 3 and extending in a widthwise direction from two opposed side portions 5, transverse to the lengthwise direction. It is noted that the head portion 3 and the foot portion 1 are identical and these may be arbitrarily reversed.

The spread has four corners portions 7, and associated with each corner 7 is a cutout or notch 9 through the fabric. The notch 9 extends inward from the foot/head edge 11 of the spread in the lengthwise direction, and forms an elongated tab 13 at the corner also extending in the lengthwise direction. The notch 9 is defined by a lengthwise border 15, an adjacent widthwise border 17, and a tab border 19. The lengthwise and widthwise borders 15 and 17 are oriented generally perpendicular to the two adjacent edges of the spread that form the particular corner 7. The notch 9 is generally square except for the width of the tab 13 (transverse to its elongated direction). Each notch 9 at least partially forms a foot or head end flap 21 and a side flap 23 on two adjacent edges.

The construction of the corners 7 can best be seen in FIG. 2. As noted above the tab 13 is elongated, and extends in a lengthwise direction from a proximal end 25 to a distal free end 27. The tab 13 is non-removeably attached to or unitarily made with the flap 23 at its proximal end 25 and has one elongated outer edge 29 in line with the edge of the flap 23 to which it is attached. An elastic strip 31 can be sewn into the tab 13, or it is otherwise made elastic through techniques well known to those skilled in the art. A snap fastener 33 is attached to the distal end 27 of the tab 13 and a mating snap fastener 35 is attached to the foot/head end flap 21 close to a corner 37 thereof.

The length of the notch borders 15 and 17 should be at least greater than the thickness of the mattress on which the spread is to be used. In general it has been found acceptable if the lengthwise border 15 of the notch 9 is made 8 inches, the widthwise border 17 is made 6 inches, the width of the tab 13 is made 2 inches, the "non stretched" length of the tab 13 is made 8 inches, and the "stretched" length of the tab 13 is made 12 inches. Further with regard to the tab 13, it is preferreable if its length is great enough to allow at least a one inch separation between the lengthwise border 15 of the notch 9 and the widthwise border 17 of the notch 9 without stretching the elastic 31 of the tab 13 when the fasteners 33 and 35 are joined. This length may vary depending on the particular positioning of the fasteners 33 and 35 on the tab 13 and flap 21.

FIG. 3 shows the bedspread in combination with a bed frame typical of bunk beds. The frame comprises corner posts 39, only one of which posts 39 is shown, and attached to the posts 39 are an end frameboard 41 at the foot and/or head, and a side frameboard 43 on each side. The frameboards 41 and 43 have a lower edge portion 45 and an upper edge portion 47. A mattress 49 is supported centrally of the frameboards 41 and 43.

With combined reference again to FIGS. 1, 2, and 3, it can be seen that the notch 9 is to align with and accomodate the post(s) 39 with the end flap 21 fitting between adjacent posts 39 at the foot or head of the bed, and the side flap 23 fitting between adjacent posts on the side(s). The flaps 21 and 23 generally extend downward of equal length below the mattress top along the vertical edges thereof, and below the lower edge portion 45 of the frameboards 41 and 43. It is desireable if the flaps 21 and 23 extend below the lower edge portion 45 of the frameboards 41 and 43 by an amount generally equal to the width of the tab(s) 13. The end flap 21 is positioned inside of the foot or head frameboard 41, in between the actual bedding and the board 41. The side flap 23 is positioned outside of the side board(s) 43.

When the bed is made, the end flaps 21 and the side flaps 23 are positioned as indicated above, and the tabs 13 are stretched at least partially around the bedpost(s) 39 exteriorly thereof, with the snaps or other fasteners 33 and 35 on the adjacent flaps and tabs engaged. In such a condition, the elastic nature of the tabs 13 pulls the bedspread tight, with the spread secured and trapped on the bed frame, giving a neat appearance.

It is noted that in the embodiment of FIGS. 1–3, the notch 9 is open to the end of the spread. The notch could be open however, to the side flap 23, with the tab being formed or otherwise attached to the end flap 21 and with the mating fastener attached at and to the corners of the side flap 23.

FIG. 4 shows an embodiment wherein shorter tabs 51 extend both in the lengthwise direction from the side flap 53 and in the widthwise direction from the end flap 55, and with mating fasteners 57 attached to the corners of adjacent flaps through the tabs 51 at the distal ends thereof.

Figure 5:
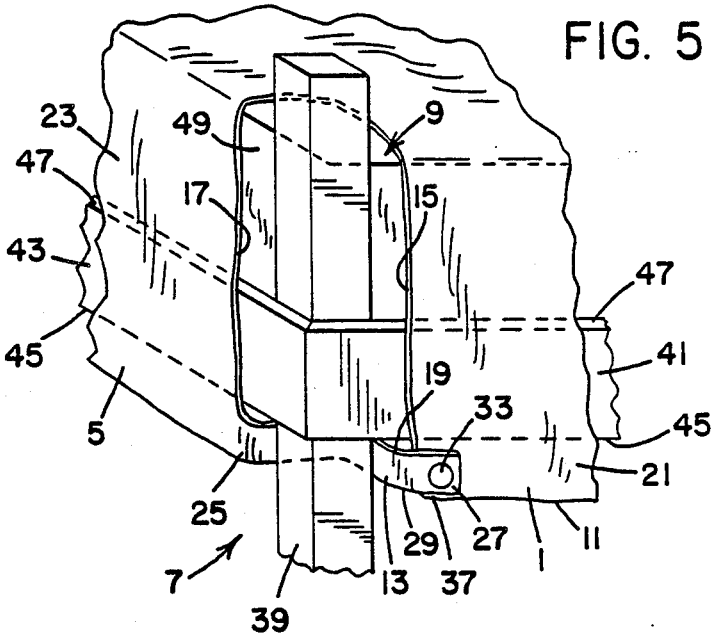
FIG. 5 is an isometric view of an alternate use of the bedspread of FIG. 1 on a bed.

FIG. 5 depicts an alternate use of the disclosed bedspread in combination with a bed frame having insufficient or inconvenient space between the bedding and the frame to place the end flap 21 therebetween. In the configuration of FIG. 5, the end flap 21 is positioned on the outside of the frameboard 41, and the tab 13 is positioned at least partially around the bedpost 39 interiorly thereof. In this configuration, the spread is thus likewise trapped and secured on the bed in a taught, neat, secured position.

For sleeping, the snaps at the head of the bed are simply unfastened, and the spread is folded back for entry.

With regard to various of the inventive aspects of the disclosed particular embodiments, it is noted that various modifications are contemplated, some of which are described as follows.

It is noted that in FIG. 1 all of the tabs 13 are oriented in the same direction. However, each corner could be different, such as described and/or depicted with reference to any of the alternate configurations. Further, any of the corners 7 could be made conventionally without the notch, tabs and/or fasteners as depicted. Also it is noted that other fasteners such as the "hook and loop" fasteners, sometimes called "velcro", or other fasteners could be substituted. Ties could even be substituted.

Although a "squared" cutout or notch 9 has been depicted, other shapes could be used.

The tabs themselves could be made totally removable from the spread, with the tab being unfastenable at each end thereof.

Having described my invention, I claim:

1. A bed and outer covering bedspread in combination comprising:

a bed having at least two bedposts, a side frame board and an end frame board, both frame boards having a lower edge;

a mattress centrally interiorly supported in said frame; and a bedspread comprising:

two opposed foot/head end edges and two opposed side edges, and four corner portions;

at least two of said corner portions being notched with a cutout therein defined by first and second adjacent borders oriented generally perpendicular to two adjacent ones of said bedspread edges respectively;

a first and second flap on said two adjacent bedspread edges, each at least partially defined by one of said borders of the cutouts, the second flap having a corner adjacent the notch and one of which flaps is positioned between the mattress and the end frame board;

a tab, located at each of said notched corner portions, which has a proximal end attached to said first flap and an opposed distal end, and which has an elongated edge generally aligned with the edge of the flap it is attached to but which extends at least partly around one of the bedposts;

a first fastener component means on the distal end of the tab; and a second fastener component means which mates to the first fastener component means and is attached to the corner of the second flap, to removeably fasten the first fastener component means to the second flap.

2. The bed and outer bedspread combination of claim 1 wherein the tabs extend around the bedpost exteriorly thereof.

3. The bed and outer bedspread combination of claim 1 wherein the tabs have sufficient length to separate the first and second border of each of said cutouts by at least one inch with the first and second fastener component means fastened.

4. The bed and outer bedspread combination of claim 3 wherein the tabs are elastic and the borders of the cutouts can be separated by at least one inch without stretching the elastic tabs with the fastener means joined.

5. The bed and outer bedspread combination of claim 1 wherein the flaps extend below the lower edge portion of the frame boards.

6. The bed and outer bedspread combination of claim 5 wherein the tabs are elastic and the borders of each of said cutouts can be separated by at least one inch without stretching the elastic tabs with the fastener means joined.

7. The bed and outer bedspread combination of claim 1 wherein the bed is a bunk bed.

8. The bed and outer bedspread combination of claim 7 wherein:

the tabs have sufficient length to separate the first and second borders of the cutouts by at least one inch when the first and second fastener component means are fastened; and the flaps extend below the lower edge portion of the frame boards.

9. The bed and outer bedspread combination of claim 8 wherein the tabs are elastic.

10. A bed and outer covering bedspread in combination comprising:

a bed having at least two bedposts, a side frame board and an end frame board, both frame boards having a lower edge;

a mattress centrally interiorly supported in said frame; and a bedspread comprising:

two opposed foot/head end edges and two opposed side edges, and four corner portions;

at least two of said corner portions being notched with a cutout therein defined by first and second adjacent borders oriented generally perpendicular to two adjacent ones of said bedspread edges respectively;

a first and second flap along said two adjacent bedspread edges, the second flap having a corner adjacent the notch, and each flap at least partially defined by one of the borders of said cutouts;

a tab, located at each of said notched corner portions, which has a proximal end attached to said first flap and an opposed distal end, and which has an elongated edge generally aligned with the edge of the bedspread it is attached to but which extends at least partly around one of the bedposts;

a first fastener component means on the distal end of the tab; and a second fastener component means which mates to the first fastener component means and is attached to the corner of the second flap, to removeably fasten the first fastener component means to the second flap.

11. The bed and outer bedspread combination of claim 10 wherein:

the tabs have sufficient length to separate the first and second borders of the cutouts by at least one inch with the first and second fastener component means fastened.

12. The bed and outer bedspread combination of claim 11 wherein the flaps extend below the lower edge portion of the frame boards.

13. The bed and outer bedspread combination of claim 11 wherein the bed is a bunk bed.

14. The bed and outer bedspread combination of claim 12 wherein the tabs are elastic.

15. The bed and outer bedspread combination of claim 10 wherein the flaps extend below the lower edge portion of the frame boards.

16. The bed and outer bedspread combination of claim 10 wherein:

the bed is a bunk bed;

the tabs have sufficient length to separate the first and second borders of the cutouts by at least one inch with the first and second fastener component means fastened; and the flaps extend below the lower edge portion of the frame boards.

17. The bed and outer bedspread combination of claim 16 wherein the tabs are elastic.

18. The bed and outer bedspread combination of claim 10 wherein the bed is a bunk bed;

the tabs have sufficient length to separate the first and second borders of the cutouts by at least one inch with the first and second fastener component means fastened; and the tabs are elastic.

19. A method of making a bed having bedposts, an end frameboard, a side frameboard, and a mattress supported centrally internally of said framboards, comprising the steps of:

placing on said mattress a bedspread having a notch in at least two corners wherein each of the notches is defined by adjacent side borders;

aligning said notches with bedposts of the bed frame;

positioning two adjacent flaps downward along vertical edges of the mattress, each of which flaps is at least partially defined by a border of one of the notches, and each of which flaps has a corner portion adjacent one of the notches;

positioning a tab attached to one of the flaps at least partially around one of the bedposts; and fastening a fastener on the tab to a mating fastener attached to the corner portion of said adjacent flap.

20. The method of claim 19 wherein the notches are generally square.

21. The method of claim 19 which further comprises: stretching an elastic tab attached to one of the flaps.

22. The method of claim 21 wherein the notches are generally square.

23. The method of claim 19 wherein said tabs have sufficient length to allow the adjacent side borders of the flaps defined thereby to be at least one inch apart with the fasteners fastened.

24. The method of claim 23 wherein the notches are generally square.

25. The method of claim 23 which further comprises stretching an elastic tab attached to one of the flaps.

26. The method of claim 25 wherein the notches are generally square.

27. The method of claim 19 which further comprises:

positioning one of said flaps between an end frame board and the mattress; and positioning said tab exteriorly of said bedpost.

28. The method of claim 27 which further comprises: stretching an elastic tab attached to one of the flaps.

29. The method of claim 28 wherein said tabs have sufficient length to allow the adjacent borders of the flaps defined thereby to be at least one inch apart with the fasteners fastened.

30. The method of claim 19 wherein the length of the notch borders of each of the notches is greater than the thickness of the mattress;

and which further comprises:

positioning the edges of the flaps below the lower edge of the frame boards.

31. The method of claim 30 wherein:

said tabs have sufficient length to allow the adjacent borders of the flaps defined thereby to be at least one inch apart with the fasteners fastened;

the bedspread is generally rectangular with four corners, and the notches are at the corners of the bedspread; and wherein all four corners of the bedspread are similarly notched.

32. The method of claim 31 which further comprises: stretching an elastic tab attached to one of the flaps.

33. The method of claim 32 wherein the notches are generally square.

34. The method of claim 31 wherein the notches are generally square.

35. The method of any of claims 19, 20, 22, 26, 27, 28, 33, or 34 wherein the bed is a bunkbed.

* * * * *